United States Patent [19]

Barkdull, Jr.

[11] Patent Number: 4,712,335

[45] Date of Patent: Dec. 15, 1987

[54] METHOD OF SPAN CONSTRUCTION

[76] Inventor: Howard L. Barkdull, Jr., 21 West Dr., Olmsted Township, Cuyahoga County, Ohio 44138

[21] Appl. No.: 942,777

[22] Filed: Dec. 17, 1986

[51] Int. Cl.[4] ..... E04B 1/345; E04G 11/04

[52] U.S. Cl. ..... 52/2; 14/1; 14/24; 52/741

[58] Field of Search ..... 52/2, 741, 745, 84, 52/80; 14/1, 27, 20, 24; 264/32

[56] References Cited

U.S. PATENT DOCUMENTS

| | | | |
|---|---|---|---|
| 511,472 | 12/1893 | Sumovski | 14/24 |
| 3,557,515 | 1/1971 | MacCracken | 52/2 X |
| 3,894,307 | 7/1975 | Delamare | 14/1 X |
| 4,155,967 | 5/1979 | South et al. | 52/80 X |
| 4,170,093 | 10/1979 | Cappellini | 52/2 X |
| 4,454,620 | 6/1984 | Barkdull | 52/2 X |

*Primary Examiner*—J. Karl Bell

*Attorney, Agent, or Firm*—D. Peter Hochberg

[57] ABSTRACT

A method of erecting a span between two points, comprising the steps of securing an elongated flexible sheath to the two end points; inflating the sheath with a gaseous fluid to form an arched tubular span connecting the two points; erecting a generally rigid frame structure supported by the tubular span, the frame structure arched at the two end points; utilizing the frame structure as support to erect a span between the two points; permanently anchoring the span at the two end points; and, removing the sheath.

7 Claims, 6 Drawing Figures

FIG. 3
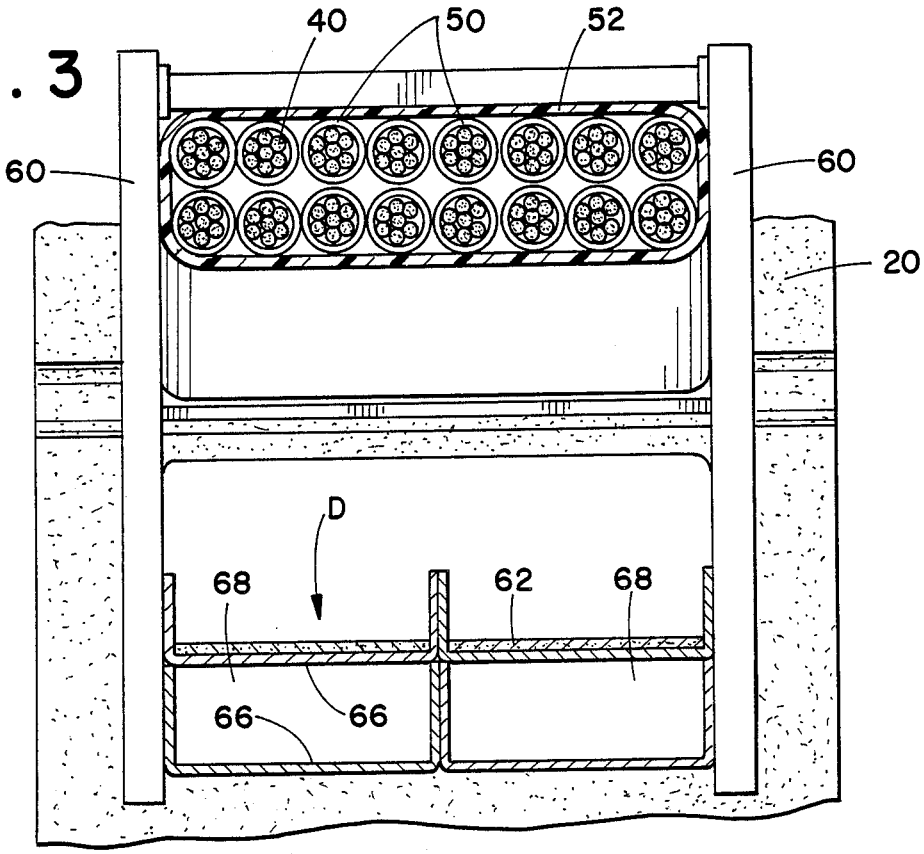
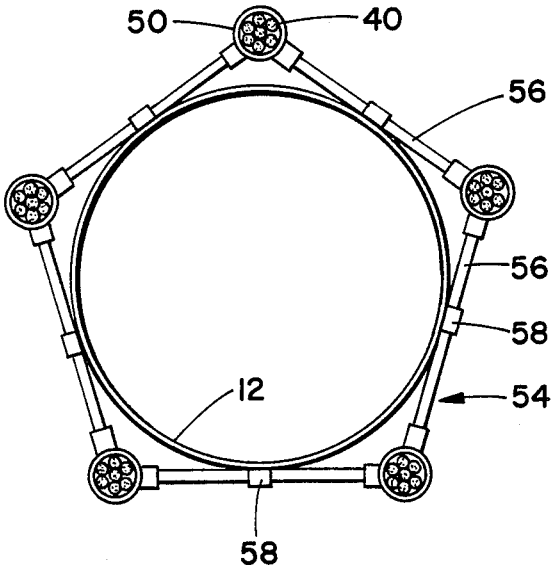
FIG. 5
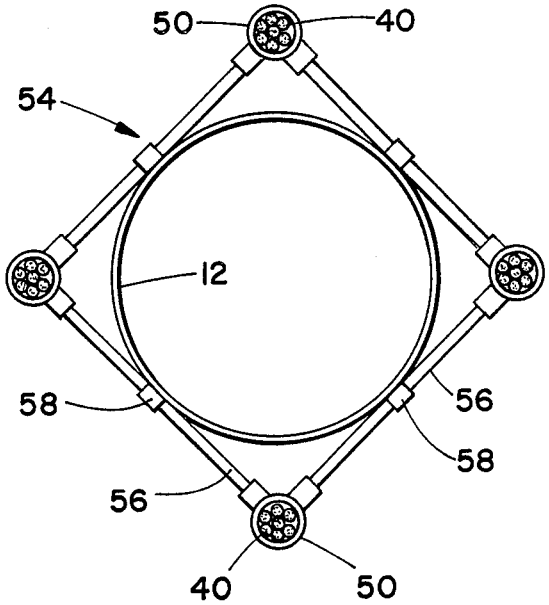
FIG. 6

METHOD OF SPAN CONSTRUCTION

FIELD OF THE INVENTION

The present invention relates to spans, such as bridges, viaducts and the like for carrying vehicular traffic, conveyors, pipe lines and bulk materials between two points, and more particularly to a novel method of construction capable of reducing the time and cost of constructing such spans.

INCORPORATION BY REFERENCE

My U.S. Pat. No. 4,454,620 is incorporated by reference herein as background information with respect to the present invention.

BACKGROUND OF THE INVENTION

The present method of constructing a bridge or a span between two points separated, by water, chasm or the like, is to construct a truss structure between the points, upon which decking forming a surface for a road or other way may be placed. More widely separated points usually require suspension of cables from towers located at each of the end points. A pan is supported by additional vertical cables attached to the longitudinal, principal cables. Long spans require additional supporting towers intermediate of the ends points of the span. A roadway or the like is then constructed on the suspended pan. The roadway is generally a stiff substructure of relatively rigid struts and beams. The present invention contemplates a new method of spanning two points, which method reduces the time, expense and difficulty generally associated with methods known heretofore by utilizing an inflatable sheath to form a temporary arch spanning the two points, which arch is of sufficient strength to support construction of a structural frame between the two points.

SUMMARY OF THE INVENTION

In accordance with the present invention, there is provided a method of erecting a span between two points, which method is comprised of the steps of: securing an elongated flexible sheath between the two end points to be spanned, inflating the sheath with a gaseous fluid to form an arched tubular span between the two points, utilizing the arched tubular sheath to erect a relatively light-weight, rigid frame structure supported thereon which frame structure is anchored at the two end points, utilizing the frame structure as support to erect the permanent span between the two points, permanently anchoring the permanent span at the two end points, and removing the flexible sheath.

More specifically, the sheath is preferably comprised of a rubberized nylon sheeting material having gas tight flexible joints connecting adjacent sheets. The sheath is preferably dimensioned to assume a circular cross-section and includes apertures along the bottom thereof such that when inflated the sheath assumes an arched configuration. In this respect, a gas source for forcing a gas such as air into the sheath is provided to maintain inflation thereof.

The arched sheath is dimensioned to be of sufficient strength to support a secondary, relatively light-weight, frame-structure between the two end points. The frame structure is preferably comprised of elongated structural members of a light-weight composite material interconnected to form a truss between the two end points. A rigid load bearing span is then erected using the frame-structure as a support and work platform. Depending on the design and parameters of the span, the frame-structure may be removed or may be incorporated as part of the final structure. The sheath is preferably removed at a convenient stage of construction after the support frame has been erected.

It is an object of the present invention to provide a method of constructing spans, bridges, viaducts and the like.

Another object of the present invention is to provide a method as described above which method utilizes an inflatable structure as a temporary support on which to build a span.

A further object of the present invention is to provide a method of construction as described above wherein a span between two points can be quickly constructed at less cost and with less material than conventionally known methods.

A still further object of the present invention is to provide a method as defined above which utilizes light-weight composite materials.

These and other objects and advantages will become apparent from the following description of a preferred embodiment of the invention taken together with the accompanying drawings.

DRAWINGS

The invention may take form in the performance of certain steps which are described in detail in the specification and illustrated in the accompanying drawing wherein:

FIG. 3 is an enlarged cross-sectional view taken along line 3—3 of FIG. 1;

FIG. 5 is a sectional view showing an embodiment of a frame structure built around an inflated sheath according to the present invention; and, FIG. 6 is a sectional view showing a second embodiment of a frame structure built around an inflated sheath.

DETAILED DESCRIPTION OF PREFERRED EMBODIMENT

Figure 1:
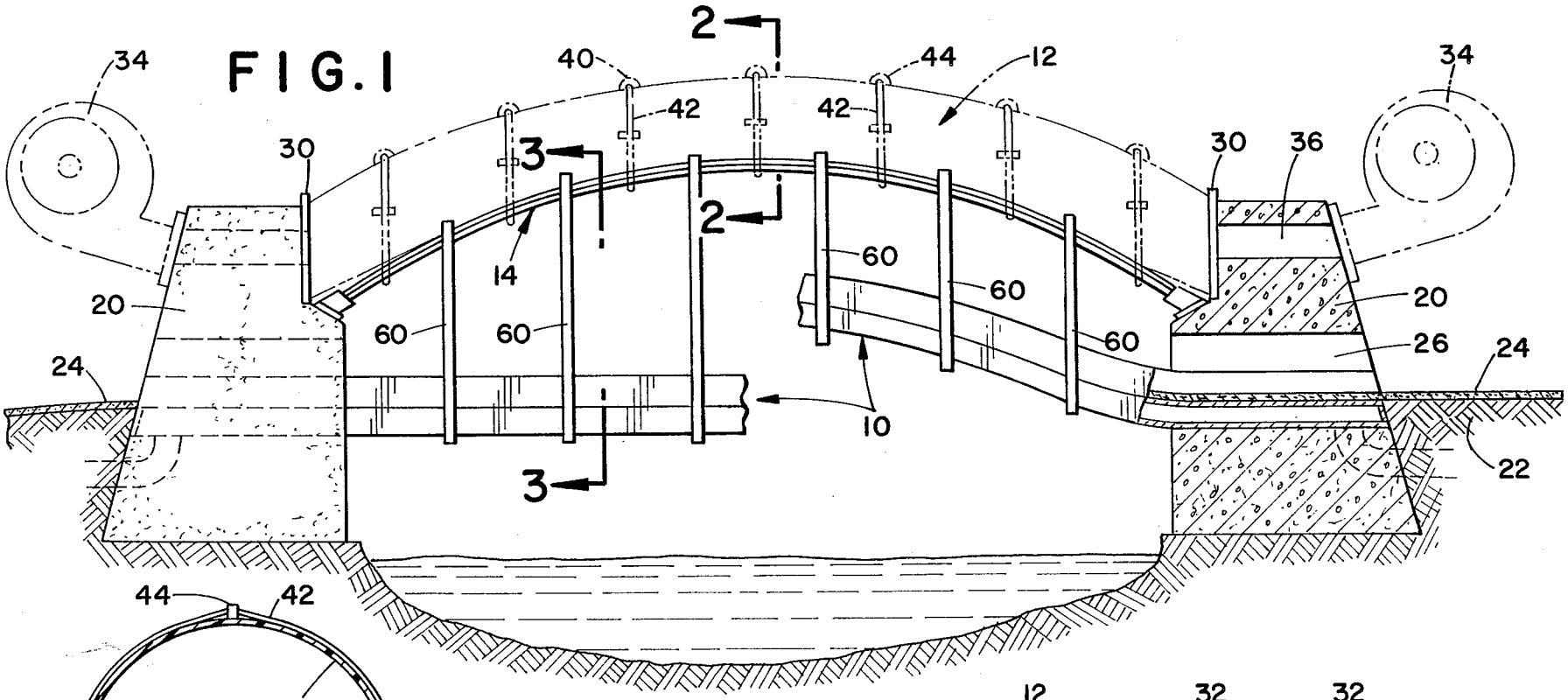
FIG. 1 is a side view, partially in section, illustrating diagrammatically rather than in proportional dimensions, a span constructed according to the present invention wherein the right-hand side of the drawing shows an arched span constructed according to the present invention, and the left-hand side of the drawing shows a flat span constructed according to the present invention.

Referring now to the drawings wherein the showing is for the purpose of illustrating a preferred embodiment of the present invention, and not for the purpose of limiting same, a method of erecting a span such as a bridge or viaduct between two points is illustrated. With respect to the drawings, the invention will be described with respect to a vehicle bridge wherein the elements are shown diagrammatically rather than in proportional dimensions. Broadly stated, the present invention pertains to a method of erecting a span 10, between two points comprised of the steps of, inflating a sheath 12 between the two points to be spanned, using the inflated sheath 12 as a support from which rod members form a rigid frame structure 14, using the rigid frame structure as a support platform from which to build the span 10 between the two points.

Referring to FIG. 1, two end supports or abutments 20 are provided at the two points to be spanned. In FIG. 1, the right end support 20 is shown in section. The end supports 20 are approached by a conventional earth work ramp 22 supporting the paved highway surface 24 at a grade required by the site to join the roadway surface 24 with the bridge span 10. Highway surface 24 extends through openings 26 in supports 20. End supports 20 are erected on suitably excavated bed-rock or suitable sub-soil base or, if the site is a deep marsh or such that the sub-soil is unstable and too deep over bed-rock or a stable stratum, the abutments 20 may be erected upon suitable piles or sunken mattress slabs in a conventional manner. Abutments 20 are usually of poured reinforced concrete or similar conventional masonry work. To secure abutments 20 to the bed-rock or other base, vertical steel or other high tensile strength anchor rods (not shown) may be used.

Figure 4:
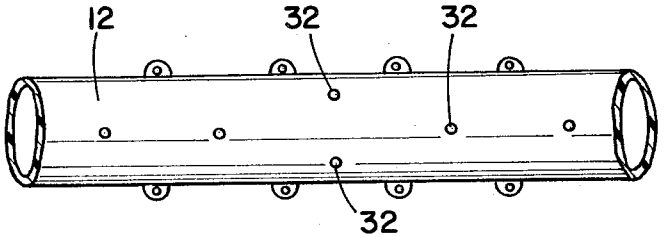
FIG. 4 is a view of the lower side of a sheath used in the present invention illustrating apertures therein.
Figure 2:
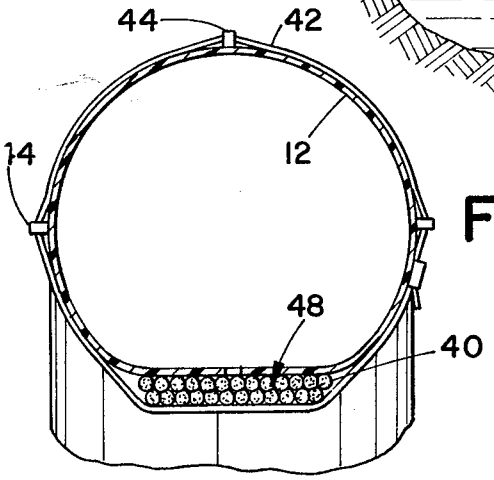
FIG. 2 is an enlarged cross-sectional view taken along line 2—2 of FIG. 1.

A flexible sheath means 12, preferably a rubberized nylon membrane spans the abutments 20. This sheath 12 is preferably comprised of a flexible material such as rubberized nylon or plastic sheeting having gas tight flexible joints connecting adjacent sheets. The sheath 12 preferably has a circular cross-sectional configuration when inflated as best seen in FIG. 2. The sheath 12 is received by annular recesses 30 in the end supports or abutments 20 which are provided with conventional substantially air-tight seals between the end supports 20 and the sheath means 12. Sheath 12 is provided with gas escape means in the form of apertures 32 along the bottom portion of the sheath 12 as best seen in FIG. 4. A gas source means for forcing a gas, such as air, into one or both ends of the sheath through the abutments is provided to inflate the sheath. The gas source means could include a jet engine or other turbine type compressor having sufficient capacity to maintain inflation of the sheath. For the purposes of illustration, the gas source means have been illustrated in phantom as rotary blowers 34 coupled through an opening 36 in the abutment 20 to the sheath 12. Gas is exhausted from the sheath through the aforementioned apertures 32 along the bottom of the sheath 12. The escaping gas produce an area of high pressure below the sheath 12. This area of high pressure, as compared to the relatively lower pressure above sheath 12, produces an air pressure differential across the sheath 12, which pressure differential produces a lift much like the wing of an aircraft. In this respect, the jet of air from the bottom side of the sheath 12 together with the general configuration of the sheath produces a naturally arched configuration as illustrated in FIG. 1. The inflated arch has sufficient strength to support light-weight structural members without the need for additional supports or planking below. According to the present invention, graphite rods 40 of circular cross-section are fastened to inflated sheath 12. The rods 40 are preferably erected individually and joined together to form a frame-like structure between the two abutments 20. In this respect, rods 40 are maintained in place by holding means which secure the rods to the sheath 12. The holding means may take the form of straps 42 as shown in FIGS. 1 and 2 extending through loops 44 integrally formed on the sheath 12. The distal ends of rods 40 are received in flanged members 46 which are secured to supports 20. FIG. 2 shows a plurality of graphite rods 40 traversing the two abutments 20 secured to the inflated sheath 12. The graphite rods 40 are banded together to form a structural member 48 capable of supporting substantially greater weight than the original sheath 12. As set forth above, these rods 40 are comprised of light weight structural material such as graphite. In this respect, they can be erected individually without excessive loads on the inflated sheath 12. Inasmuch as the stress on the rods 40 is greatest near abutments 20, the cross-sectional diameter of rods 40 may be progressively reduced away from abutments 20. FIGS. 3, 5 and 6 show the graphite rods 40 are encased in tubular members 50 to form a more rigid cross-sectional structure. In this respect, the rod members 40 may be grouped together in a number of different ways to form a structural framework for supporting the span. When connected to flange members 46, each rod 40 forms an individual arch which helps support its own weight. Attachment of additional rods 40 increases the cross-sectional area of the group and thus increased the groups structural stability. In FIG. 3, the encased rods 40 are joined together by a band or strap 52 which maintains the position and alignment of the respective groups of rods 40.

FIGS. 5 and 6 show frameworks which can be built around inflated sheath 12 to provide a more rigid frame 54 spanning the two points. Individual rods 40 are encased in tubular member 50, which members 50 are interconnected by connecting rod members 56 to form frame 54. Fastening means 58 may be provided on sheath 12 to support connecting rod members 56 during construction of frame 54.

Assembly of rods 40 thus provides a frame-like structure of sufficient strength to support construction of the load-bearing span 10. Using the framelike structure as a support, the final road bed or span 10 can be built by conventional means by supporting such span from the frame-like structure. FIG. 3 is a cross-sectional view taken along 3-3 of FIG. 1, showing an arrangement wherein predetermined numbers of rod members 40 are encased within tubular members 50 which are enclosed within a band 52 to provide a permanent support spanning the two abutments. In the embodiment shown, lateral supports 60 suspended by the secondary framework formed by rods 40 support a final road bed.

Span 10 is preferably comprised of structural members formed into a box-like arrangement as shown in FIG. 3. In this respect, U-shaped members 66 are joined to form road bed 62 and a utility area 68 therebelow for pipes, electrical lines or the like. In the preferred embodiment, U-shaped members 66 are preferably comprised of a light-weight metal such as aluminum. The box-like arrangement provided additional stability to span 10.

FIG. 3 shows an embodiment wherein the load-bearing span is supported below the frame structure of rods 40. As will be appreciated, span 10 may be located at other positions relative to the frame structure. For instance, a span may be centrally located within frame structures 54 shown in FIGS. 5 and 6. In this respect, depending on the position of load-bearing span 10, the inflated sheath 12 is removed at a convenient point after the frame of rod member 40 has been completed. It will also be appreciated that the number of structural members and their arrangement, will depend upon the distance to be spanned between the two abutments 20, the load to be carried by the span, and the configuration of the span. With respect to rod members 40, such members may be incorporated as a permanent part of span 10, or may be utilized merely as a temporary support structure during construction and removed after completion of the load being span 10.

In FIG. 1, the righthand side shows diagrammatically a span formed according to the present invention wherein the span is arched between the two abutments 20. The left-hand side shows a planar span which may be formed utilizing the same sheath 12 and rods 40. It will thus be appreciated that the present invention find advantageous application in the construction of a variety of different types of span. The use of a gas inflated sheath to erect a secondary framework of light-weight composite members provides a method of construction which could enable construction of spans in less time and at less cost.

The present invention has been described with respect to preferred embodiments. Other modifications and alterations will appear to others skilled in the art upon the reading and understanding the present disclosure. It is intended that all such alterations and modifications fall within the scope of the patent as claimed and the equivalents thereof.

I claim:

1. A method of erecting a span between two points, comprising the steps of:

securing an elongated, flexible tubular sheath to said two points, said tubular sheath having an upper side and a lower side which has apertures of predetermined dimension and spacing disposed therealong:

inflating said sheath with a gaseous fluid to form an arched tubular span connecting said points, inflation of said sheath creating a pressure differential between the upper and lower sides thereof caused by said gaseous fluid exiting said apertures;

maintaining inflation of said tubular span to effect a constant pressure differential across said tubular sheath, said pressure differential creating an upward force gradient on said tubular span;

erecting a generally rigid frame structure supported by said tubular span said upward force gradient supporting erection of said structure;

anchoring said frame structure at said two points;

utilizing said frame structure as support to erect a permanent load-bearing span between said two points;

permanently anchoring said span at said two points; and deflating and removing said sheath.

2. A method as defined in claim 1 wherein said flexible sheath is a plastic tube of circular cross-section.

3. A method as defined in claim 1 wherein said frame structure is comprised of light-weight tubular members.

4. A method as defined in claim 1 including the step of removing said frame structure.

5. A method as defined in claim 1 wherein said rigid-frame structure is comprised of light-weight composite structural member.

6. A method as defined in claim 1 wherein said span is comprised of U-shaped members assembled in a box-like configuration.

7. A method as defined in claim 6 wherein said span is comprised of aluminum.

* * * * *